US006576121B2

(12) United States Patent
Zeuthen et al.

(10) Patent No.: US 6,576,121 B2
(45) Date of Patent: Jun. 10, 2003

(54) PROCESS FOR THE CATALYTIC HYDROTREATING OF SILICON CONTAINING NAPHTHA

(75) Inventors: Per Zeuthen, Allerød (DK); Lars Pleth Nielsen, Allerød (DK); Steffen Vissing Christensen, Hørsholm (DK); Joachim Jacobsen, Copenhagen (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 09/950,523

(22) Filed: Sep. 10, 2001

(65) Prior Publication Data

US 2002/0056665 A1 May 16, 2002

(30) Foreign Application Priority Data

Sep. 15, 2000 (DK) ..... 2000 01370

(51) Int. Cl.[7] ..... C10G 45/04

(52) U.S. Cl. ..... 208/217; 208/213; 208/254 R; 208/216 R; 208/254 H

(58) Field of Search ..... 208/213, 254 R, 208/216 R, 217, 254 H

(56) References Cited

U.S. PATENT DOCUMENTS 4,176,047 A 11/1979 Orrell et al.
4,196,102 A 4/1980 Inooka et al.
4,645,587 A * 2/1987 Kokayeff ..... 208/91
5,118,406 A 6/1992 Kokayeff et al.
5,173,173 A * 12/1992 Vauk ..... 208/91

OTHER PUBLICATIONS

Lars Kellberg, Per Zeuthen and Hans J. Jakobsen, *Deactivation of HDT Catalysts by Formation of Silica Gels from Silicone Oil, Characterization of Spent Catalysts from HDT of Coker Naphtha Using* $^{29}$ *Si and* $^{13}$ *C CP/MAS NMR*, Reprinted from Journal of Catalysis, vol. 143, 45–51 (1993).

M. Tajima, "Decomposition of Chlorofluorocarbons in the Presence of Water Over Zeolite Catalyst", *Applied Catalysis B: Environmental*, vol. 9, No. 1–4 (1996) pp. 167–177.

* cited by examiner

*Primary Examiner*—Walter D. Griffin
*Assistant Examiner*—James Arnold, Jr.
(74) *Attorney, Agent, or Firm*—Dickstein Shapiro Morin & Oshinsky, LLP

(57) ABSTRACT

Process for the catalytic hydrotreating of a hydrocarbon feed stock containing silicon compounds by contacting the feed stock in presence of hydrogen with a hydrotreating catalyst at conditions to be effective in the hydrotreating of the feed stock, the improvement of which comprises the step of moisturising the hydrotreating catalyst with an amount of water added to the feed stock between 0.01 and 10 vol %.

2 Claims, No Drawings

PROCESS FOR THE CATALYTIC HYDROTREATING OF SILICON CONTAINING NAPHTHA

The present invention relates to a process for the catalytic hydrotreating of silicon containing naphtha feed stock.

The catalytic reformer and its associated naphtha hydrotreater are found in every modern refinery. With the advent of bimetallic reforming catalysts, the reformer feed sulphur and nitrogen are required to be very low, normally less than 0.5 ppm. When the naphtha hydrofiner processes straight-run feeds, meeting these requirements while achieving cycle lengths of greater than 3 years is not difficult even using low activity or regenerated catalysts.

Because of its lower installation cost relative to other options, the delayed coker is often the system of choice for upgrading residual oils. However, delayed coker products cause additional processing difficulties in downstream units, particularly hydrotreaters and reforming catalysts are found to be sensitive to silicon deposits. For example, the residue from silicone oils used to prevent foaming in coker drums largely distils in the naphtha range and can cause catalyst deactivation in downstream naphtha hydrofiners and reforming units.

Naphtha is contaminated by silicon when silicone oil is injected in the well during petroleum extraction in deep water.

The origin of silicon deposits, on naphtha hydrotreating catalysts, can be traced back to the silicone oil added to the heavy residue feed of the delayed coker or to the silicone oil added to the silicone dwell (Kellberg, L., Zeuthen, P. and Jakobsen, H. J., Deactivation of HDT catalysts by formation of silica gels from silicone oil. Characterisation of spent catalysts from HDT of coker naphtha using $^{29}Si$ and $^{13}C$ CP/MAS NMR, J. Catalysis 143, 45–51 (1993)).

Because of gas formation, silicone oil (polydimethylsiloxane, PDMS) is usually added to the coker drums to suppress foaming. This silicone oil usually cracks or decomposes down in the coker to form modified silica gels and fragments. These gels and fragments mainly distil in the naphtha range and are passed to a hydrotreater together with the coker naphtha. Other coker products will also contain some silicon, but usually at lower concentrations than in naphtha products.

Silica poisoning is a severe problem when hydroprocessing coker naphthas. The catalyst operation time will typically depend on the amount of silicon being introduced with the feedstock and on silicon "tolerance" of the applied catalyst system. In absence of silicon in the feed, most naphtha hydroprocessing catalyst cycle lengths exceed three years. Deposition of silicon in form of a silica gel with a partially methylated surface from coker naphthas deactivates the catalyst and reduces the typical HDS unit cycle lengths often to less than one year.

By selection of an appropriate catalyst, unit cycle lengths can be significantly extended over most typical naphtha hydrotreating catalysts.

Silicon uptake depends on type of catalyst and temperatures in the hydrotreater. An increase in temperature results in a higher uptake of the contaminants.

Typical conditions for naphtha pre-treatment reactors are hydrogen pressures between 20 and 50 bars; average reactor temperature between 50° C. and 400° C. The exact conditions will depend on type of feedstock, the required degree of desulphurisation and the desired run length. The end of the run is normally reached when the naphtha leaving the reactor contains detective amounts of silicon.

For a refiner, the run length is a very important consideration. A shorter run length incurs high cost due to frequent catalyst replacement and extended downtime (time off-stream) for catalyst replacement resulting in loss of revenue because of less production of naphtha and feed to the reforming unit.

The general object of the invention is to increase operation time of hydrotreating reactors for treatment of silicon containing feedstock by improving silicon capacity of hydrotreating catalysts.

Accordingly, this invention is a process for the catalytic hydrotreating of a hydrocarbon feed stock containing silicon compounds by contacting the feed stock in presence of hydrogen with a hydrotreating catalyst at conditions to be effective in the hydrotreating of the feed stock, the improvement of which comprises the step of moisturising the hydrotreating catalyst with an amount of water added to the feed stock between 0.01 and 10 vol %.

When sufficiently moisturising of the hydrotreating catalyst by preferably adding water to the treat gas or the naphtha feedstock, the number of reactive surface-OH species on the catalysts is increased with an increase of the silicon capacity of the hydrotreating catalyst. Thereby, the operation time of the catalyst is advantageously extended at content of water up to 10% by volume calculated on the volume of feed stock contacting the catalyst. Typically water concentration of between 0.1 and 3% by volume increase sufficiently the silicon capacity the catalyst.

Silicon is highly dispersed on the catalyst surface and initially form monolayer coverage on the surface. The amount of silicon uptake depends then on the surface of a catalyst. The higher the surface area, the higher the silicon uptake at constant catalyst metals loading. A constant flow of water to the catalyst will further increase the amount of silicon accumulated on the surface of the catalyst.

Catalyst employed frequently in hydrotreating reactors for hydrotreating petroleum fractions contains usually at least one metal on a porous refractory inorganic oxide support. Examples of metals having hydrotreating activity include metals from groups VI-B and VIII e.g. Co, Mo, Ni, W, Fe with mixtures of Co—Mo, Ni—Mo and Ni—W preferred. The metals are usually in the form of oxides or sulphides. Examples of porous material suitable as support include alumina, silica-alumina and alumina-titania, whereby alumina and silica-alumina are preferred.

The active metal on the catalyst may either be pre-sulphided or in-situ sulphided prior to use by conventional means. The hydrotreating reactor section may consist of one or more reactors. Each reactor has one or more catalyst beds. The function of the hydrotreating reactor is primarily to reduce product sulphur, nitrogen, and silicon. Owing the exothermic nature of the desulphurisation reaction and olefin saturation, the outlet temperature is generally higher than the inlet temperature.

EXAMPLES

Example 1

Experiments are performed at ambient pressure using a conventional hydrotreating catalyst.

TK-439 commercially available from Haldor Topsoe A/S, Denmark, on a high surface area γ-alumina with a HBET surface area at 380 $m^2/g$ and a pore volume at 0.6 g/c.c., has been shown to have high Si capacity.

The impact of $H_2O$ (the presence of surface —O—H groups) was examined by measuring the Si absorption capacity of the catalyst after having been exposed to air at ambient conditions (fresh) and pre-wetted catalysts as compared to the Si capacity of in situ dried catalysts. The latter is known to have a lower density of surface —O—H groups.

The Si absorption capacity is measured by bubbling He (100 Nml/min) through a Si-model probe molecule hexamethyldisiloxane (HMDSi) held at T=0° C., HMDSi has a bp. at 101° C. and a silicon content at 17.2%. The gas contains approximately 0.17 vol % Si balanced with He. HMDSi consumption was analysed on-line by means of a calibrated mass-spectrometer. The catalyst material is tested at two different temperatures: 350° C. and 400° C.

Results and conditions of the above experiments are summarised in Table 1.

TABLE 1

| TK-439 | Si capacity (mmole/g) | Capacity increase (%) |
|---|---|---|
| Si absorption capacity measured at T = 350° C. | | |
| Fresh | 0.71 | 22% |
| Dry | 0.58 | |
| Si absorption capacity measured at T = 400° C. | | |
| Pre-wetted | 0.91 | 15% |
| Fresh | 0.79 | |

Example 2

Table 2 shows the Si capacity at 400° C. when adding a gas stream saturated with $H_2O$ to the feed used in Example 1. The gas composition is close to 1.4 vol % $H_2O$ and 0.5 vol % HMDSi balanced He.

TABLE 2

| TK-439 | Si capacity (mmole/g) | Capacity increase (%) |
|---|---|---|
| Without $H_2O$ | 1.10 | 26 |
| With $H_2O$ | 1.39 | |

What is claimed is:

1. Process for the catalytic hydrotreating of a hydrocarbon feed stock containing silicon compounds by contacting the feed stock in presence of hydrogen with a hydrotreating catalyst at conditions to be effective in the hydrotreating of the feed stock, the improvement of which comprises the step of moisturising the hydrotreating catalyst with an amount of water added to the feed stock is between 0.01 and 10 vol %.

2. Process of claim 1, wherein the amount of water added to the feed stock is between 0.1 and 3 vol %.

* * * * *